US006449449B1

(12) United States Patent
Kadonaga

(10) Patent No.: US 6,449,449 B1
(45) Date of Patent: Sep. 10, 2002

(54) APPARATUS FOR IMAGE FORMING AND CHARGING CAPABLE OF EFFECTIVELY MAINTAINING A CHARGE POTENTIAL

(75) Inventor: Masami Kadonaga, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/619,577

(22) Filed: Jul. 19, 2000

(30) Foreign Application Priority Data

Jul. 19, 1999 (JP) ..... 11-204743

(51) Int. Cl.[7] ..... G03G 15/02
(52) U.S. Cl. ..... 399/176; 361/225
(58) Field of Search ..... 399/168, 169, 399/174, 176; 361/225

(56) References Cited

FOREIGN PATENT DOCUMENTS

| | | | |
|---|---|---|---|
| JP | 04-006567 | | 1/1992 |
| JP | 05-273841 | | 10/1993 |
| JP | 8-20725 | * | 1/1996 |
| JP | 8-146718 | * | 6/1996 |
| JP | 11-316482 | | 11/1999 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A charging apparatus for use in an image forming apparatus includes a charge roller configured to adjoin to a photoconductive member to provide a charge to a surface of the photoconductive member. The charge roller includes a plurality of roller layers. One of the plurality of roller layers has a resistance ratio with which a roller surface potential is raised by a charge movement. In this case, the resistance ratio has a value such that a time period in which a charge moves within the one of the plurality of roller layers is sufficiently smaller than a time period in which an arbitrary point of the surface of the charge roller moves across a discharge region formed between the charge roller and the photoconductive member.

4 Claims, 10 Drawing Sheets

FIG. 3A $$\frac{1}{\sqrt{g}}\frac{\partial}{\partial \xi}\sqrt{g}\left(\varepsilon g^{11}\frac{\partial \Phi}{\partial \xi}\right)+\frac{1}{\sqrt{g}}\frac{\partial}{\partial \xi}\sqrt{g}\left(\varepsilon g^{12}\frac{\partial \Phi}{\partial \eta}\right)$$
$$+\frac{1}{\sqrt{g}}\frac{\partial}{\partial \eta}\sqrt{g}\left(\varepsilon g^{21}\frac{\partial \Phi}{\partial \xi}\right)+\frac{1}{\sqrt{g}}\frac{\partial}{\partial \eta}\sqrt{g}\left(\varepsilon g^{22}\frac{\partial \Phi}{\partial \eta}\right)=-q$$

FIG. 3B $$\left(g^{ij}\right)=\frac{1}{g}\begin{pmatrix} x_\eta^2+y_\eta^2 & -x_\xi\cdot x_\eta-y_\xi\cdot y_\eta \\ -x_\xi\cdot x_\xi-y_\xi\cdot y_\eta & x_\xi^2+y_\xi^2 \end{pmatrix}$$

FIG. 3C $$\sqrt{g}=x_\xi\cdot y_\eta-x_\eta\cdot y_\xi$$

FIG. 3D $$\frac{\partial q}{\partial t} = \frac{1}{\sqrt{g}}\frac{\partial}{\partial \xi}\left(\sqrt{g}\cdot\sigma\cdot g^{11}\frac{\partial \Phi}{\partial \xi}\right) - \frac{1}{\sqrt{g}}\frac{\partial}{\partial \xi}\sqrt{g}\left(q\cdot V^{\xi}\right)$$

$$+\frac{1}{\sqrt{g}}\frac{\partial}{\partial \xi}\left(\sqrt{g}\cdot\sigma\cdot g^{12}\frac{\partial \Phi}{\partial \eta}\right) - \frac{1}{\sqrt{g}}\frac{\partial}{\partial \xi}\sqrt{g}\left(q\cdot V^{\xi}\right)$$

$$+\frac{1}{\sqrt{g}}\frac{\partial}{\partial \eta}\left(\sqrt{g}\cdot\sigma\cdot g^{21}\frac{\partial \Phi}{\partial \xi}\right) - \frac{1}{\sqrt{g}}\frac{\partial}{\partial \eta}\sqrt{g}\left(q\cdot V^{\eta}\right)$$

$$+\frac{1}{\sqrt{g}}\frac{\partial}{\partial \eta}\left(\sqrt{g}\cdot\sigma\cdot g^{22}\frac{\partial \Phi}{\partial \eta}\right) - \frac{1}{\sqrt{g}}\frac{\partial}{\partial \eta}\sqrt{g}\left(q\cdot V^{\eta}\right)$$

FIG. 3E $$\Delta q = \left(V_{AB} - V_{Pa}\right)\frac{(D+G)\cdot\varepsilon_0}{D\cdot G}$$

APPARATUS FOR IMAGE FORMING AND CHARGING CAPABLE OF EFFECTIVELY MAINTAINING A CHARGE POTENTIAL

CROSS-REFERENCE TO RELATED APPLICATIONS

This application claims priority to Japanese patent application No. JPAP11-204743 filed on Jul. 19, 1999 in the Japanese Patent Office, the entire contents of which are hereby incorporated by reference.

BACKGROUND

1. Field

The present invention relates to a method and apparatus for image forming, and more particularly to a method and apparatus for image forming that is capable of effectively maintaining a charge potential.

2. Description of the Related Arts

Charging the surface of a photoconductive member is one of the basic and important processes performed in an image forming apparatus using an electrophotographic method, such as a copying machine, a facsimile machine, a printer, and so forth. Among a variety of techniques for consistently charging the surface of the photoconductive member, one exemplary techniques uses a charging member which is configured to make its surface contacting the photoconductive member so as to provide charges evenly to the surface of the photoconductive member. For example, a roller is suitably used as the charging member. Such a charging system using a charging roller has been widespread.

The charging system is often referred to as a main charging system in order to be distinguished from a charging system employed in a transfer mechanism. In particular, the charging system using a roller is referred to as a main charge roller system. This main charge roller system causes a discharge between the charge roller and the photoconductive member so as to provide an even charge on the surface of the photoconductive member. In the main charge roller system, whether the charge roller makes contact with the photoconductive member or not is not necessarily important factor to be considered but more important is to make a distance of a gap between these two members as small as possible. Accordingly, the main charge roller system usually has a charge roller in contact with the photoconductive member. A distance of 100 $\mu$m or less of the gap between the charge roller and the photoconductive member is generally considered to be sufficient to make a consistent charge on the photoconductive member, provided that the charge roller is made of an optimum material and is applied with a charge of an optimum-voltage during an actual charging operation.

In the above-described main charge roller system, an efficiency of the charging operation which is obtained by dividing a charge potential by an applied voltage depends on a temperature of the charge roller. Accordingly, lower the environmental temperature, lower the charging efficiency. That is, in the main charge roller system using a constant-voltage control, the charge potential obtained under the constant-voltage control will be reduced when the charging efficiency is reduced. In this case, the main charge roller system will have problems of a reduction of image density and in controlling the image forming process in which the charge potential is used as a reference value for controlling the process.

Japanese Laid-Open Patent Publication No. JPAP4-6567 (1992) describes a charging member which is heated to have a temperature in a range of from 35° C. to 55° C. However, this attempt has a drawback that the parts, such as the photoconductive member, other than the charge roller are also heated at the same time. More specifically, if the photoconductive member is heated to a relatively high temperature in a toner recycling system in which the toner remaining on the photoconductive member is collected and is returned back to a development unit, the toner remaining on the photoconductive member will also be heated and will likely change the character which causes various kinds of problems such as a toner blocking, a deterioration of toner agglomeration, and so on when it is reused in the development unit. In addition, the above-mentioned attempt has another drawback that the mechanism for heating the charge roller causes an increase of the manufacturing cost.

SUMMARY

The present invention provides a novel charging apparatus. In one example, a novel charging apparatus includes a charge roller configured to adjoin to a photoconductive member so as to provide a charge to a surface of the photoconductive member. This charge roller includes a plurality of roller layers. One of the plurality of roller layers has a resistance ratio with which a roller surface potential is raised by a charge movement. In this case, the resistance ratio has a value such that a time period in which a charge moves within the one of the plurality of roller layers is sufficiently smaller than a time period in which an arbitrary point of the surface of the charge roller moves across a discharge region formed between the charge roller and the photoconductive member.

The present invention further provides another charging apparatus including a charge roller configured to adjoin to a photoconductive member so as to provide a charge to a surface of the photoconductive member. In this case, the charge roller includes a plurality of roller layers. One of the plurality of roller layers has a resistance ratio with which an excess current flow between a surface of the charge roller and the surface of the photoconductive member is prohibited. This resistance ratio has a value such that a time period in which a charge moves within the one of the plurality of roller layers is sufficiently greater than a time period in which an arbitrary point of the surface of the charge roller moves across a discharge region formed between the charge roller and the photoconductive member.

The present invention further provides another charging apparatus including a charge roller configured to adjoin to a photoconductive member so as to provide a charge to a surface of the photoconductive member. In this case, the charge roller includes at least one roller layer having a resistance ratio which is defined in a way such that when a charge performance of the charge roller is obtained by calculating a relationship between the resistance ratio of the at least one roller layer and a charge potential of the surface of the photoconductive member using formulae of an Ohm's law with consideration given to an advection member for a charge flow in two-dimensional directions within the at least one roller layer, a two-dimensional Poisson's equation, and a Paschen's discharge law, the calculated relationship includes two constant-potential regions in both which the charge potential stays at an approximate constant level relative to the resistance ratio and a resistance ratio in one of the two constant-potential region is selectee.

The present invention further provides another charging apparatus including a charge roller configured to adjoin to a photoconductive member so as to provide a charge to a surface of the photoconductive member. In this case, the charge roller includes a plurality of roller layers. One of the plurality of roller layers has a resistance ratio with which a roller surface potential is raised by a charge movement. The resistance ratio is defined in a way such that when a charge performance of the one of the charge rollers is obtained by calculating a relationship between the resistance ratio of the one of the roller layers and a charge potential of the surface of the photoconductive member using formulae of an Ohm's law with consideration given to an advection member for a charge flow in two-dimensional directions within the one of the roller layers, a two-dimensional Poisson's equation, and a Paschen's discharge law, the calculated relationship includes two constant-potential regions in both which the charge potential stays at an. approximate constant level relative to the resistance ratio and a resistance ratio in one of the two constant-potential region is selected.

The present invention further provides another charging apparatus including a charge roller configured to adjoin to a photoconductive member so as to provide a charge to a surface of the photoconductive member. In this case, the charge roller includes a plurality of roller layers. One of the plurality of roller layers has a resistance ratio with which an excess current flow between a surface of the charge roller and the surface of the photoconductive member is prohibited. The resistance ratio is defined in a way such that when a charge performance of the charge roller is obtained by calculating a relationship between the resistance ratio of the one of the roller layers and a charge potential of the surface of the photoconductive member using formulae of an Ohm's law with consideration given to an advection member for a charge flow in two-dimensional directions within the one of the roller layers, a two-dimensional Poisson's equation, and a Paschen's discharge law, the calculated relationship includes two constant-potential regions in both which the charge potential stays at an approximate constant level relative to the resistance ratio and a resistance ratio in one of the two constant-potential region is selected.

The present invention further provides another charging apparatus including a charge roller configured to adjoin to a photoconductive member so as to provide a charge to a surface of the photoconductive member. In this case, the charge roller includes at least first and second roller layers. The first roller layer has a first resistance ratio with which a roller surface potential is raised by a charge movement. The second roller layer has a second resistance ratio with which an excess current flow between a surface of the charge roller and the surface of the photoconductive member is prohibited. The first resistance ratio has a value such that a charge movement time period in which a charge moves inside the first roller layer is sufficiently smaller than a process time period in which an arbitrary point of the surface of the charge roller moves across a discharge region formed between the charge roller and the photoconductive member. The second resistance ratio has a value such that the charge movement time period is sufficiently greater than the process time period.

The present invention further provides another charging apparatus including a charge member, a voltage applying circuit, a temperature detector, and a voltage controller. The charge member is configured to adjoin to a photoconductive member so as to provide a charge to a surface of the photoconductive member. The voltage applying circuit is configured to apply a voltage to the charge member. The temperature detector detects a temperature of or around the charge member and generating a signal variable in accordance with a detection result. The voltage controller is configured to calculate an electric field to obtain an optimum voltage to be applied to the charge member at a temperature of the charge member represented by the signal from the temperature detector so that the photoconductive member has an appropriate charge potential and to control the voltage applying circuit to generate and to apply the optimum voltage to the charge member.

In the above-mentioned charging apparatus, the charge member may be a charge roller including a plurality of roller layers and the voltage controller may include a memory for storing a data table having data representing a relationship between a temperature of the charge roller and each resistance ratio of the plurality of the roller layers. The voltage controller may obtain each resistance ratio of the plurality of the roller layers based on the signal from the temperature detector. The voltage controller may calculate the electric field based on the obtained each resistance ratio of the plurality of the roller layers to obtain the optimum voltage to be applied to the charge member so that the photoconductive member has the appropriate charge potential.

In the above-mentioned charging apparatus, the voltage controller may calculate the electric field to obtain the optimum voltage to be applied to the charge roller so that the photoconductive member has the appropriate charge potential with consideration given to variations of a resistance, a thickness, and a capacitor of each roller layer of the charge roller over time and variations of a resistance, a thickness, and a capacitor of the photoconductive member over time.

The voltage controller may calculate the electric field to obtain the optimum voltage to be applied to the charge roller so that the photoconductive member has the appropriate charge potential with consideration given to formulae of an Ohm's law with consideration given to an advection member for a charge flow in two-dimensional directions within the one of the roller layers, a two-dimensional Poisson's equation, and a Paschen's discharge law.

Further, the present invention provides a novel image forming apparatus including a photoconductive member and a charging mechanism for charging the photoconductive member. The charging mechanism includes a charge roller configured to adjoin to the photoconductive member so as to provide a charge to a surface of the photoconductive member. In this case, the charge roller includes a plurality of roller layers. One of the plurality of roller layers has a resistance ratio with which a roller surface potential is raised by a charge movement. The resistance ratio has a value such that a time period in which a charge moves within the one of the plurality of roller layers is sufficiently smaller than a time period in which an arbitrary point of the surface of the charge roller moves across a discharge region formed between the charge roller and the photoconductive member.

Further, the present invention provides a novel method for manufacturing a charging apparatus. In one embodiment, a novel method for manufacturing a charging apparatus includes the steps of providing a photoconductive member and providing a charge roller with at least first and second roller layers. In this case, the first roller layer has a first resistance ratio with which a roller surface potential is raised by a charge movement. The second roller layer has a second resistance ratio with which an excess current flow between a surface of the charge roller and a surface of the photoconductive member is prohibited. The first resistance ratio has a value such that a charge movement time period in which a charge moves inside the first roller layer is sufficiently smaller than a process time period in which an arbitrary point of the surface of the charge roller moves across a discharge region formed between the charge roller and the photoconductive member. The second resistance ratio has a value such that the charge movement time period is sufficiently greater than the process time period. The novel method further includes a step of adjoining the charge roller to the photoconductive member so as to charge the surface of the photoconductive member.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein:

FIGS. 3A–3E are formulae with respect to an Ohm's law with consideration given to an advection member for a charge flow in two-dimensional directions within each roller layer, a two-dimensional Poisson's equation, and a Paschen's discharge law;

DETAILED DESCRIPTION

Figure 1:
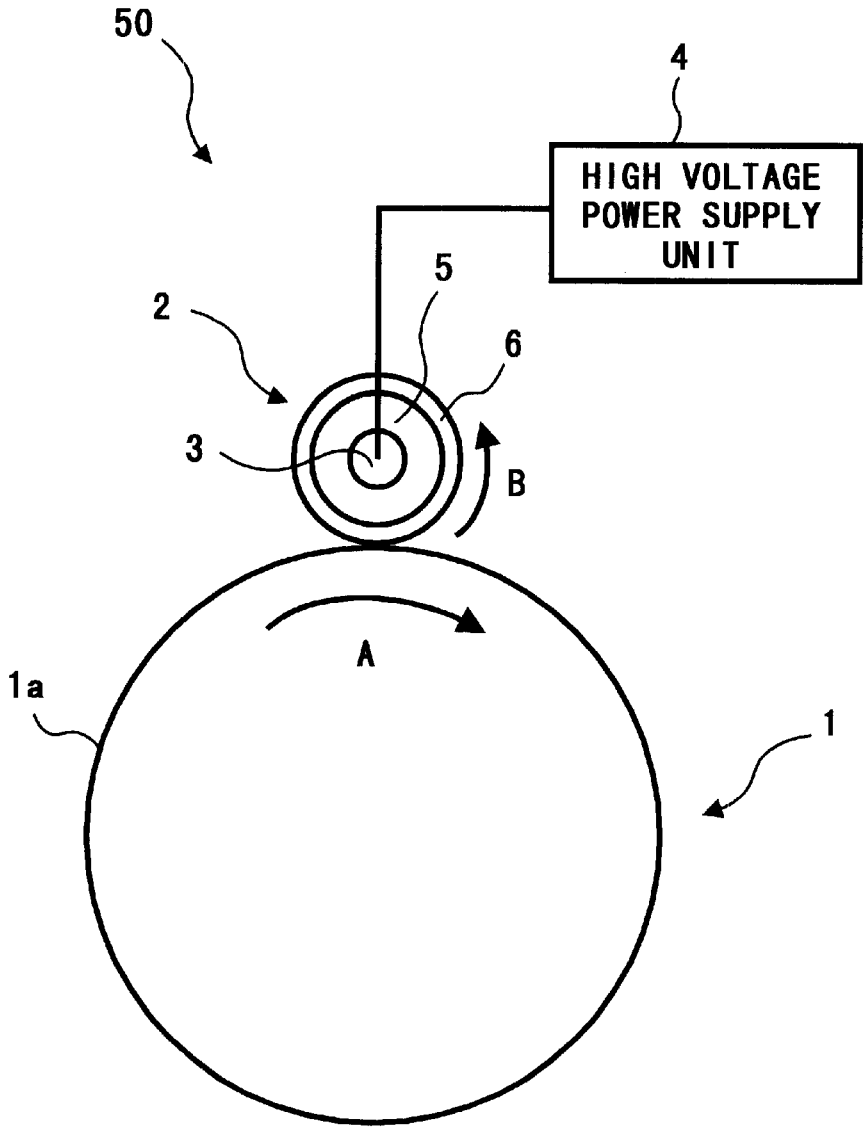
FIG. 1 is an illustration for showing a charging apparatus according to an embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents which operate in a similar manner.

Referring now to the drawings, wherein like reference numerals designate identical or corresponding parts throughout the several views, particularly to FIG. 1, there is illustrated a main charge system 50 according to an embodiment of the present invention. The main charge system 50 of FIG. 1 is used in an image forming apparatus and includes a drum-shaped photoconductive member 1 driven by a power supply source (not shown) to rotate in the direction indicated by a letter A, a main charge roller 2 following the rotation of the photoconductive member 1 to rotate in the direction indicated by a letter B, and a high voltage power supply unit 4 for supplying a high voltage to the main charge roller 2. Reference numeral 1*a* denotes a surface of the photoconductive member 1. The main charge roller 2 includes a metal core 3 and a plurality of layers including an elastic layer 5 and a surface layer 6, and is arranged in contact with the photoconductive member 1. Accordingly, the surface 1*a* of the photoconductive member 1 is evenly charged with a high voltage power supplied from the high voltage power supply unit 4 through the main charge roller 2.

The main charge roller 2 may be deposited in a place having a close distance to the photoconductive member 1 so as to form a relatively small space between the photoconductive member 1 and the main charge roller 2.

The elastic layer 5 allows the movement of charges so as to raise a surface voltage of the main charge roller 2, and the surface layer 6 protects an excess amount of the current flowing between the photoconductive member 1 and the main charge roller 2. The elastic layer 5 is arranged to have a resistance ratio with which a time period of charge movement during which the charges move inside the elastic layer 5 is made smaller than a time period of a process during which an arbitrary point of the main charge roller 2 passes through a discharge region. On the other hand, the surface layer 6 is arranged to have a resistance ratio with which a time period of charge movement during which the charges move inside the surface layer 6 is made greater than a time period of a process during which an arbitrary point of the main charge roller 2 passes through a discharge region.

Relationships between each of the resistance ratios of the elastic layer 5 and the surface layer 6 and the charge potential of the photoconductive member 1 can be obtained by calculations. The calculations are based on the Ohm's law in consideration of the advection member, i.e., the charge flow in the two-dimensional directions within each of the elastic layer 5 and the surface layer 6. The calculations are further based on the two-dimensional Poisson's equation, and the Paschen's discharge law.

Figure 2:
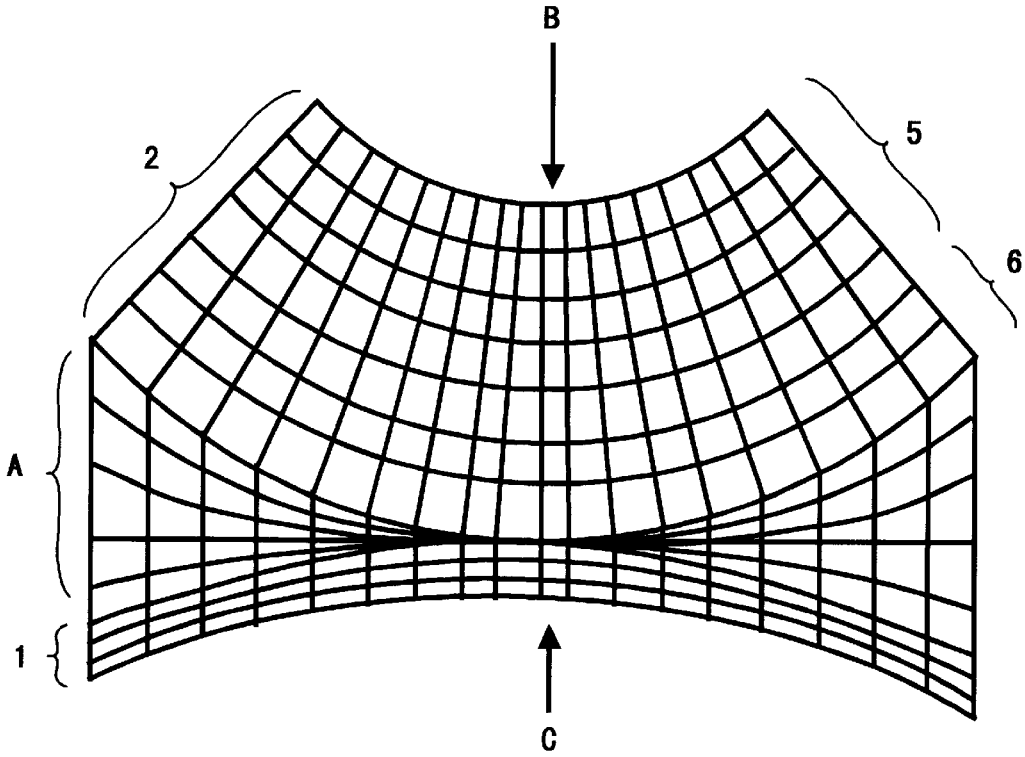
FIG. 2 is an illustration for showing a division of surfaces of a main charge roller and a photoconductive member and a space between the two for a calculation of electric field performed in the charging apparatus of FIG. 1.

Actually, a charge can move not only in the direction of the thickness but also in the direction of the circumference within each of the elastic layer 5 and the surface layer 6. Therefore, in order to conduct a more accurate analysis, it is needed to calculate a two-dimensional electric field. Since each roller layer has a curved shape, the calculation of the electric field will not fit to a rectangular coordinate system and it fits to a curved mesh-form, as illustrated in FIG. 2. In this example, a general coordinate system is used and each of the elastic layer 5 and the surface layer 6 are divided in a mesh-form, as illustrated in FIG. 2. That is, the elastic layer 5 is divided into a 5-layer mesh and the surface layer 6 is divided into a 2-layer mesh. In addition, the photoconductive member 1 is divided into a 3-layer mesh and a space A formed between the photoconductive member 1 and the main charge roller 2 is divided into a 5-layer mesh. These division numbers may be input as data by the user or may suitably be calculated by the program. Although it will be perfect if the entire circumference of the main charge roller 2 is subjected to be calculated, it may be sufficient enough to calculate about a one-third of the entire circumference of the main charge roller 2, as shown in FIG. 2.

The potential and the charge movement in each mesh form shown in FIG. 2 are calculated. For the mesh formed between the main charge roller 2 and the surface 1*a* of the photoconductive member 1, the calculation of the charge movement by the discharge is added. As illustrated in FIG. 2, the region subjected to be calculated is specified by the following boundary conditions. An upper boundary B is set as a constant voltage boundary (an applied voltage). A lower boundary C is set as a constant voltage boundary (a ground voltage). Each of left and right boundaries is set as a symmetric boundary.

FIGS. 3A–3E show exemplary ways for calculating a relationship between a resistance ratio of each roller layer of the main charge roller 2 and a charge potential of the photoconductive member 1. A first way is to seek a solution of the Poisson's equation using a calculus of finite differences, as shown in FIGS. 3A–3C. Of course, the calculus of finite differences is not only the way for solving the Poisson's equation, but other ways such as a boundary element method, a finite element method, or a principle of charge superposition may also conduct a solution as well. FIG. 3A shows the Poisson's equation using the general coordinate system. FIGS. 3B and 3C show equations for providing conditions to the Poisson's equation. In the Poisson's equation and the condition equations, each of $\xi^1=\xi$, $\xi^2=\eta$, and $g^{ij}$ represents a measurement tensor, g represents a Jacobian of a coordinate conversion, q represents a volume charge density, $\phi$ represents a potential, and $\epsilon$ represents a permittivity of a roller layer of the main charge roller 2. Further, $\partial$ represents the function of partial derivatives, and $x\xi$ and $y\xi$ represent the partial derivatives of x with $\xi$ and the partial derivatives of y with $\xi$, respectively. In FIG. 3B, $g^{ij}$ is specified as $g^{11}$ representing an element of a tensor having a column and a row and $g^{12}$ representing an element of a tensor having a column and two rows. Further, x and y represent variants in the rectangular coordinate system and $\xi$ and $\eta$ represent those in the general coordinate system.

A second way for calculating the relationship between the resistance ratio of each roller layer of the main charge roller 2 and the charge potential of the photoconductive member 1 is to seek a solution of the Ohm's law using the calculus of finite differences with the general coordinate system. In the Ohm's law shown in FIG. 3D, V represents a line velocity of the photoconductive member 1, which equals to a process speed, and a represents an electric conductivity which equals to an inverse of a volume resistance ratio.

FIG. 3E represents an equation for calculating an amount of charge produced by a discharge caused between the surface of the main charge roller 2 and the photoconductive member 1. The discharge is caused when a potential difference $V_{AB}$ between a point A of the surface of the main charge roller 2 and a point B of the surface of the photoconductive member 1 exceeds a discharge limit $V_{pa}$ according to the Paschen's discharge law, wherein the point A is arbitrarily specified on the surface of the main charge roller 2 and the point B is specified on the surface of the photoconductive member 1 so as to meet an extension of a radius of the main charge roller 2 crossing the point A. When such a discharge occurs, a charge of $\Delta q$ moves to the surface of the photoconductive member 1 and a charge of $-\Delta q$ moves to the surface of the main charge roller 2. This charge of $\Delta q$ is calculated with the equation of FIG. 3E.

In the equation of FIG. 3E, an element D equals to $\Sigma d_i/\epsilon'i$, wherein d- represents a thickness of each layer of the main charge roller 2 in meters and the photoconductive member 1 and $/\epsilon'i$ represents a permittivity. Further, an element $V_{AB}$ represents a potential difference between the points A and B in volts and $V_{PA}$ represents a discharge start voltage in volts obtained by the Paschen's law. Further, an element G represents a distance of a gap between the points A and B in meters.

The entire amount of the discharge caused between the main charge roller 2 and the photoconductive member 1 is obtained by calculating the charge $\Delta q$ using the equation of FIG. 3E on every possible point A on the surface of the main charge roller 2, which is in fact the above-mentioned mesh form shown in FIG. 2. Thereby, the amount of charges moving from the main charge roller 2 to the photoconductive member 1 can be calculated.

The above-described electric field calculation, the charge movement, and the discharge are set to a sequential operation which is repeated. By proceeding the calculations with repeating this sequential operation, an accurate charge density of the photoconductive member 1 can be obtained. In addition, a charge potential V can be calculated with a capacitor C of the photoconductive member 1 based on an equation Q=CV.

Figure 4:
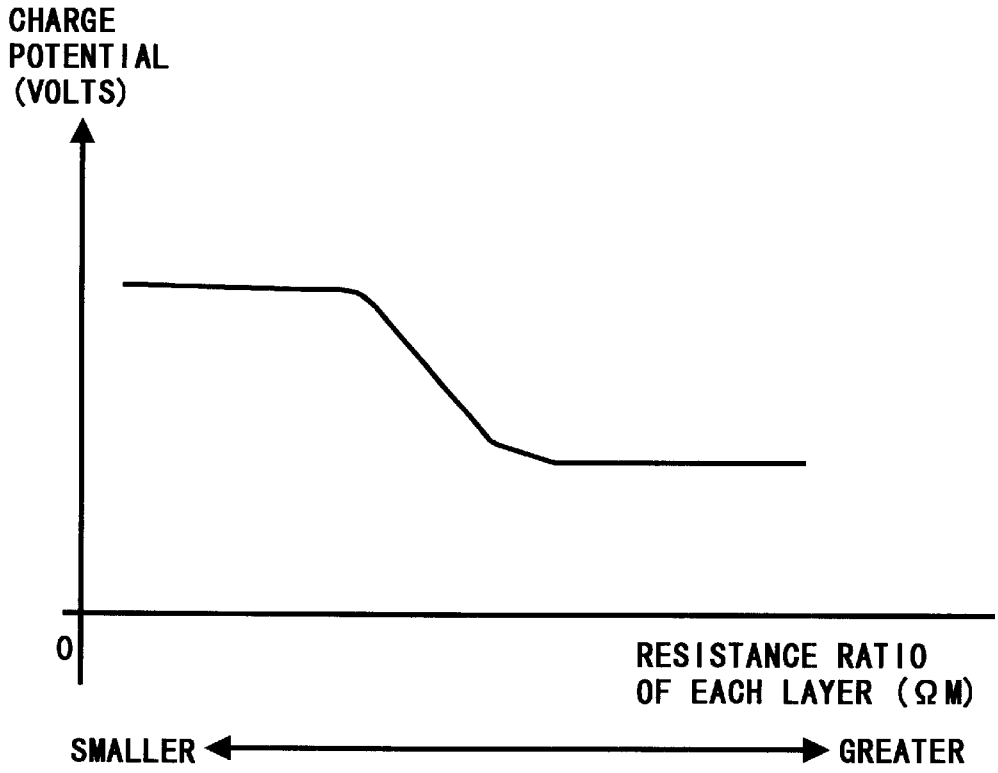
FIG. 4 is a graph for showing a general relationship between a charge potential of the photoconductive member and a resistance ratio of each roller layer of the main charge roller.
Figure 5:
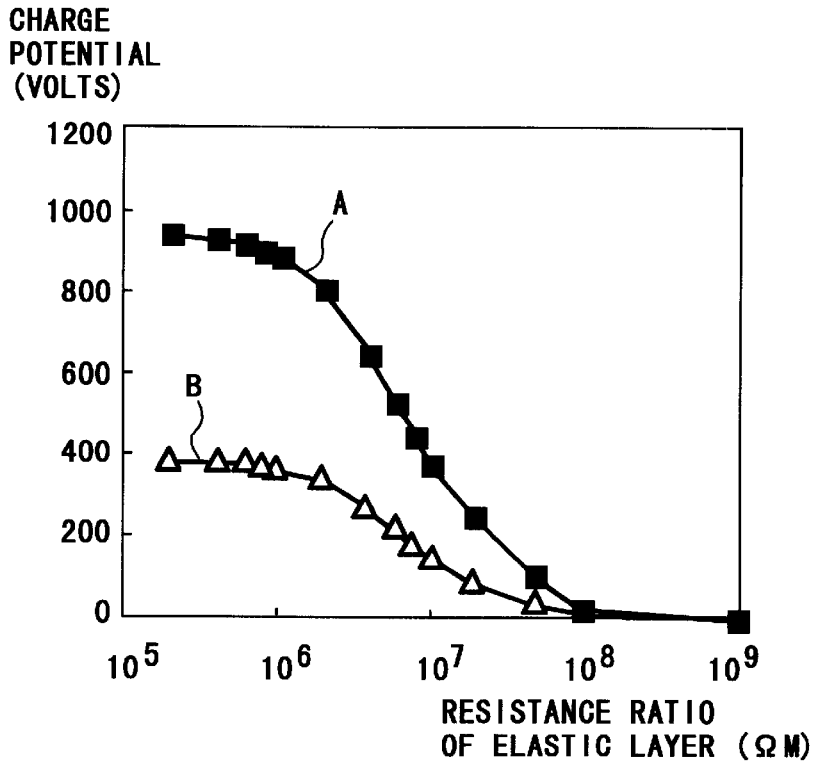
FIGS. 5 and 6 are graphs for showing simulative relationships between the charge potential of the photoconductive member and a resistance ratio of an elastic layer of the main charge roller and between the charge potential of the photoconductive member and a resistance ratio of a surface layer of the main charge roller, respectively.
Figure 6:
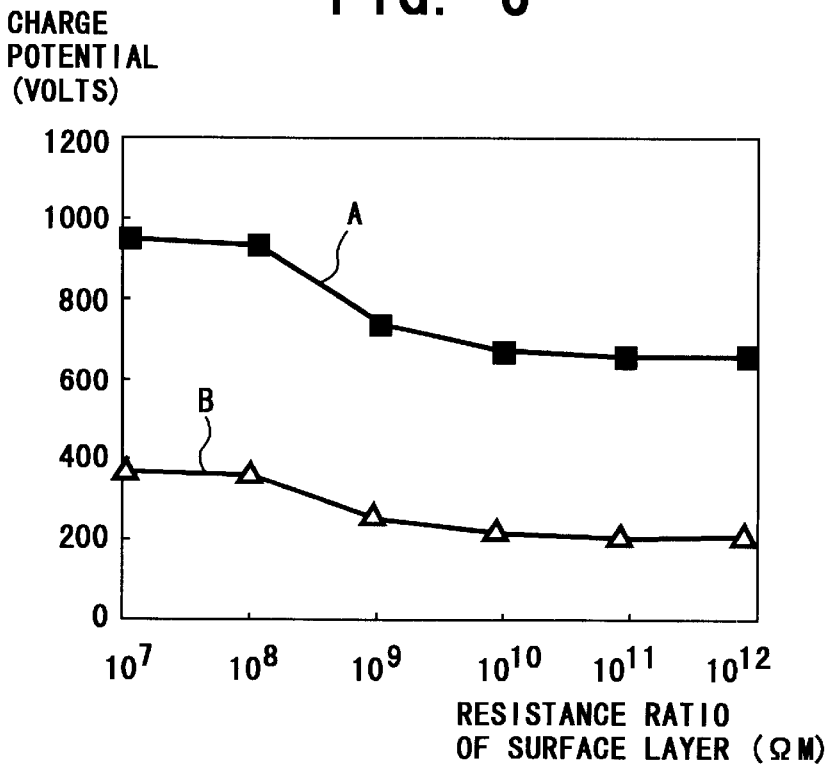

Referring to FIGS. 4–6, exemplary relationships between the resistance ratio of each roller layer and the charge potential of the photoconductive member 1 are explained on the basis of the calculations using the formulae of FIGS. 3A–3E. In this example, the calculations are conducted with the condition that the main charge roller 2 is in contact with the surface of the photoconductive member 1. However, the discharge actually occurs in a space formed between the main charge roller 2 and the photoconductive member 1. Therefore, a similar result may be obtained in the case of the non-contact type main charge system in which the main charge roller 2 is apart from the surface of the photoconductive member 1.

Since the elastic layer 5 generally has a lower resistance, a charge is expected to be able to smoothly move within the elastic layer 5. On the other hand, the surface layer 6 is provided for the purpose of protecting a flow of a large current at a local point when the photoconductive member 1 has a pin-hole or a surface flaw and a charge is expected to be prevented from the smooth movement within the surface layer 6. Although each layer of the main charge roller 2 may be made of a single layer or multiple layers, a roller. layer allowing a charge to smoothly move is regarded as the elastic layer and the one preventing a current flow is regarded as the surface layer, regardless of the layer configuration.

FIG. 4 is a graph showing a general relationship between the resistance ratio of a roller layer of the main charge roller 2 and the charge potential of the photoconductive member 1, wherein the vertical axis represents the charge potential and the horizontal axis represents the resistance ratio. FIG. 5 is a graph showing results of simulations performed on the basis of the above-mentioned calculations with regard to the relationship between the resistance ratio of the elastic layer 5 of the main charge roller 2 and the charge potential of the photoconductive member 1. In FIG. 5, letters A and B represent cases where voltages of 1600 volts and of 1000 volts are applied, respectively, to the main charge roller 2. As conditions for the calculation, the main charge roller 2 has a radius of 7 mm, and the photoconductive member 1 has a line velocity of 200 mm/s, a radius of 30 mm, a thickness of 25 $\mu$m, and a relative permittivity of 3.

As illustrated in FIG. 5, when the calculation is performed with the resistance ratio of the elastic layer 5 varied in the range of from $10^5$ Ωm to $10^9$ Ωm, the charge potentials of both A and B cases likely stay almost at a constant level with the resistance ratio below $10^6$ Ωm but rapidly drop down at the level around above $10^6$ Ωm.

The elastic layer 5 of the main charge roller 2 commonly has a thickness of some millimeters. Therefore, if the charge cannot smoothly move inside the elastic layer 5, the surface potential of the photoconductive member 1 will not rise and the discharge between the main charge roller 2 and the photoconductive member 1 is curbed. This causes a reduction of the charge potential on the photoconductive member 1.

Therefore, it is possible to consider that the charge is prevented from the movement by a too high resistance when the resistance ratio of the elastic layer 5 is set to a value over $10^6$ Ωm. On the other hand, it is possible to consider that the charge movement is smoothly conducted when the resistance ratio of the elastic layer 5 is set to a value below $10^6$ Ωm.

As to whether the charge movement within the roller layer is small or large can be explained by a comparison of a time period $\tau(\cong\epsilon\rho)$ in which the charge moves in the elastic layer 5 and a time period T in which an arbitrary point on the main charge roller 2 passes through the region where the discharge occurs. The time period T can be placed with an approximate value obtained by dividing a width of a nip by the line velocity of the photoconductive member 1, for example. In this case, the nip is specified as a place where the main charge roller 2 makes contact with the photoconductive member 2 in the moving direction of the photoconductive member 1.

When $\tau<T$, the charge can smoothly move in the roller layer, the roller surface potential is sufficiently raised, and the charge potential of the photoconductive member 1 will be stable. This condition is represented in the area of the resistance ratio below $10^6$ Ωm in FIG. 5.

When $\tau\cong T$, the charge potential of the photoconductive member 1 will be unstable. This condition is represented in the area of the resistance ratio over $10^6$ Ωm in FIG. 5. In a case when the resistance ratio of the elastic layer 5 is large enough (i.e., $10^9$ Ωm), the time period $\tau$ is greater than the time period T. In this case, less amount of the charge movement is caused and the elastic layer 5 is considered to be an insulating material. Although the charge potential will stably be 0 volts in this case, it will not function as a main charge roller.

As such, the elastic layer 5 of the main charge roller 2 is needed to have the resistance ratio below $10^6$ Ωm with which the charge potential stays at an approximate constant value, as shown in FIG. 5, satisfying the condition of $\tau<T$, although the charge potential is approximately constant in the range of the resistance ratio below $10^6$ Ωm and over $10^8$ Ωm. Thereby, the charge can smoothly move within the elastic layer 5 of the main charge roller 2.

FIG. 6 is a graph showing a relationship between the resistance ratio of the surface layer 6 of the main charge roller 2 and the charge potential of the photoconductive member 1 on the basis of the calculations using the formulae of FIGS. 3A–3E. In FIG. 6, letters A and B indicates cases in which the main charge roller 2 is applied with voltages of 1600 volts and 1000 volts, respectively. As conditions for the calculation, the main charge roller 2 has a radius of 7 mm, and the photoconductive member 1 has a line velocity of 200 mm/s, a radius of 30 mm, a thickness of 25 $\mu$m, and a relative permittivity of 3.

As shown in FIG. 6, the calculation is performed with the resistance ratio of the surface layer 6 varied in the range of from $10^7$ Ωm to $10^{12}$ Ωm. The charge potentials of both A and B cases likely stay almost at a constant level with the resistance ratio either below $10^8$ Ωm or over $10^{10}$ Ωm but vary in the range of from $10^8$ Ωm to $10^{10}$ Ωm.

In other words, the charge smoothly moves within the surface layer 6 below $10^8$ Ωm. Therefore, it is understood that $\tau$ is sufficiently smaller than T below $10^8$ Ωm, in a similar manner as is in the case of elastic layer 5 shown in FIG. 5. In the range over $10^{10}$ Ωm, however, the charge movement is prevented, that is, the surface layer 6 functions as an insulation material. In the range of $10^8$ Ωm to $10^{10}$ Ωm where $\tau$ is greater than T, $\tau$ is actually closer to T (i.e., $\tau\cong T$). In this case, the surface layer 6 having the resistance ratio in the range of $10^8$ Ωm to $10^{10}$ Ωm shows a potential resistance dependency.

Since the surface layer 6 is aimed to curb the charge movement, the region of the graph of FIG. 6 having the lower resistance ratio cannot be used but the region having the higher resistance ratio where $\tau$ is greater than T is suitable for the surface layer 6.

As such, the surface layer 6 of the main charge roller 2 is needed to have the resistance ratio over $10^{10}$ Ωm with which the charge potential stays at an approximate constant value, as shown in FIG. 6, satisfying the condition of $\tau>T$, although the charge potential is approximately constant in the range of the resistance ratio below $10^8$ Ωm and over $10^{10}$ Ωm.

The above considerations are based on the calculations of the main charge system in which the main charge roller is caused to make contact with the photoconductive member. However, the charging mechanism itself is based on the discharge occurring at an extremely small space formed between the main charge roller and the photoconductive member. Therefore, it is readily understood that the case where the main charge roller makes no contact with the photoconductive member would bring a result similar to that described above.

Figure 7:
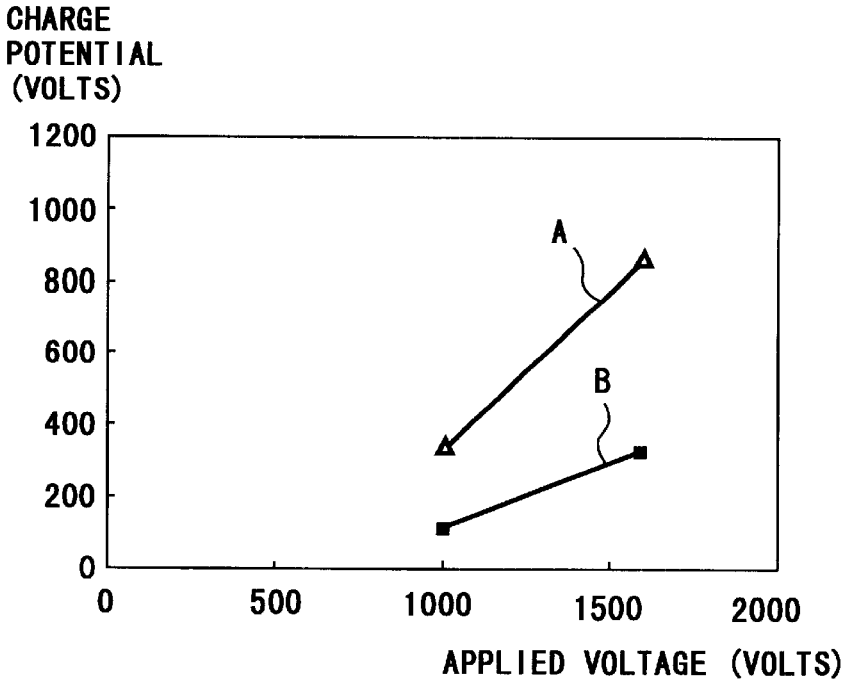
FIGS. 7 and 8 are graphs for showing simulative relationships between the charge potential of the photoconductive member and a voltage applied to the main charge roller with the variations of resistance ratios of the elastic and surface layers.

FIG. 7 is a graph showing a relationship between the voltage applied to the main charge roller 2 and the charge potential of the photoconductive member 1. The purpose of this graph of FIG. 7 is to study variations of the charging characteristic relative to the environmental changes between the conditions of the normal temperature and humidity and the conditions of the lower temperature and humidity. In FIG. 7, a letter A indicates a case of the conditions having the normal temperature and humidity and a letter B indicates a case of the conditions having the lower temperature and humidity. The elastic layer 5 of the main charge roller 2 has the resistance ratios of $10^6$ Ωm under the conditions having the normal temperature and humidity and of $10^8$ Ωm under the conditions having the lower temperature and humidity. Further, the elastic layer has a thickness of 3 mm, and the surface layer has a thickness of 7.5 $\mu$m. In addition, the calculations are made on the assumption that the resistance ratio of the roller layer would be different between the cases A and B by an order of magnitude.

According to the graph of FIG. 7, it is understood that the charging characteristic varies with the environment changes when the elastic and surface layers 5 and 6 have the resistance ratios of $10^6$ Ωm and $10^8$ Ωm, respectively. That is, the charging characteristic in the case A having the conditions of the normal temperature and humidity is greatly different from that in the case B having the conditions of the lower temperature and humidity. As described above, $10^6$ Ωm is the value of the resistance ratio for the elastic layer 5 with which the charging-potential is made approximately constant, and $10^8$ Ωm is the value of the resistance ratio for the surface layer with which the charging potential is made approximately constant.

Figure 8:
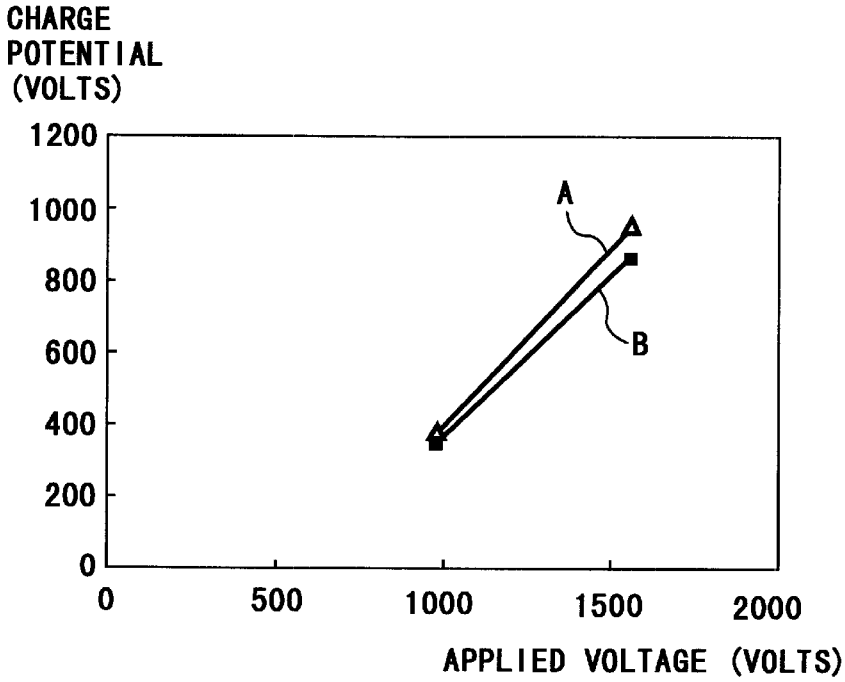

FIG. 8 is a graph showing the relationship between the voltage applied to the main charge roller 2 and the charge potential of the photoconductive member 1 in a manner similar to that shown in FIG. 7, except for the roller layers each arranged to have a different resistance ratio. In this case, the elastic layer 5 is arranged to have the resistance ratio of $10^5$ Ωm, which is sufficiently smaller than the above border ratio $10^5$ Ωm, and the surface layer 6 is arranged to have the resistance ratio of $10^{12}$ Ωm, which is sufficiently greater than the above border ratio $10^8$ Ωm, under the conditions of the normal temperature and humidity. In addition, the elastic layer 5 has a thickness of 3 mm, and the surface layer 6 has a thickness of 7.5 μm, which are same as in the case of FIG. 7.

From the graph of FIG. 8, it is readily understood that the charge potentials in the cases A and B are close each other. As described above, the cases A and B are under the conditions having the normal temperature and humidity and the conditions having the lower temperature and humidity, respectively, and have the difference in the resistance ratio by an order of magnitude. Accordingly, the charge potential of FIG. 8 is ideal. Therefore, the elastic layer 5 is needed to have the resistance ratio of $10^5$ Ωm, for example, which makes τ sufficiently smaller than T. Further, the surface layer 6 is needed to have the resistance ratio of $10^{11}$ Ωm, for example, which makes τ sufficiently greater than T.

Figure 9:
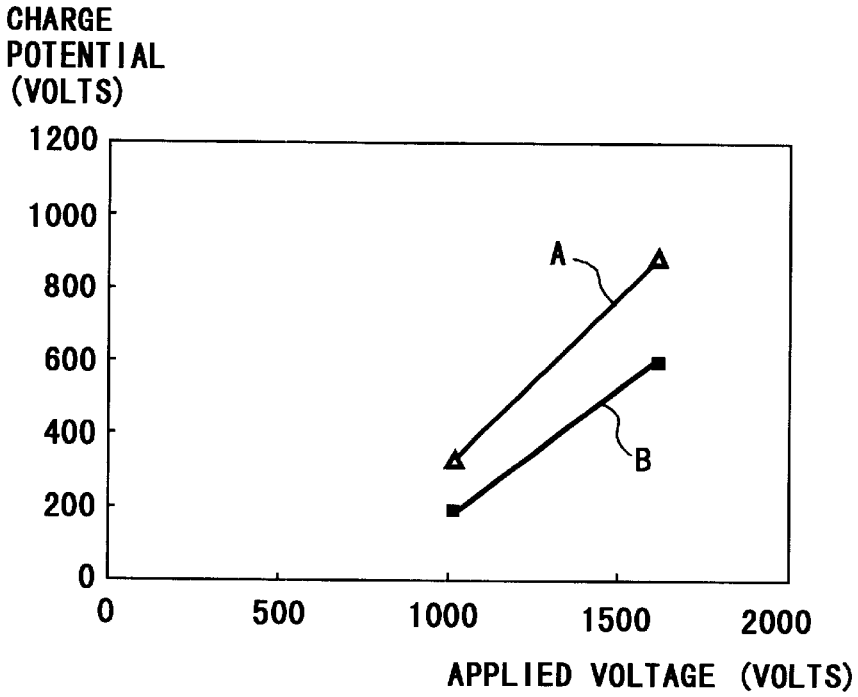
FIGS. 9 and 10 are graphs for showing experimental relationships between the charge potential of the photoconductive member and the voltage applied to the main charge roller with the variations of resistance ratios of the elastic and surface layers.
Figure 10:
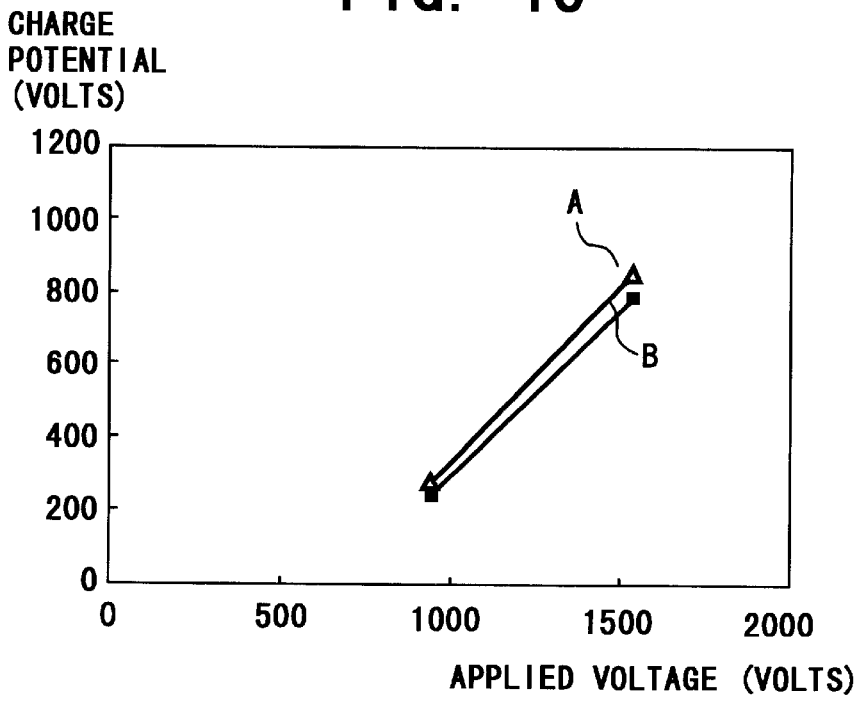

Referring to FIGS. 9 and 10, an experimental study result of the charge potential using a prototype of the main charge roller is explained. FIG. 9 is a graph showing the relationship between the voltage applied to the main charge roller 2 and the charge potential of the photoconductive member 1 using a prototype of the main charge roller 2. In this experiment, the elastic layer 5 was made of epichlorohydrin rubber to have the resistance ratio of $10^6$ Ωm and the surface layer 6 was made of fluorine resin and hydrin rubber to have the resistance ratio of $10^8$ Ωm.

While an image forming apparatus employing the main charge system 50 having this main charge roller 2 is operated, the charge potential relative to the voltage applied to the main charge roller 2 is measured under the condition A having the normal temperature and humidity and under the condition B having the lower temperature and humidity. The main charge system 50 includes a detector (not shown) for detecting an environmental temperature around the main charge roller 2. The main charge system 50 is capable of controlling the voltage to apply to the main charge roller 2 according to the detected temperature so as to maintain the charge potential of the photoconductive member at a constant level.

From this experiment result, it is understood that the charge potential under the condition B is largely reduced in comparison with that measured under the condition A.

FIG. 10 is a graph also showing the relationship between the voltage applied to the main charge roller 2 and the charge potential of the photoconductive member 1 using the prototype of the main charge roller 2. In this experiment, the elastic layer 5 was made of lower resistant epichlorohydrin rubber to have the lower resistance ratio of $10^5$ Ωm and the surface layer 6 was made of high resistant nylon resin to have the resistance ratio of $10^{11}$ Ωm.

From the graph of FIG. 10, it is understood that the charge potential is stable relative to the environmental difference between the conditions A and B. Accordingly, the main charge roller 2 in this case does not need an additional mechanism such as the one for compensating the voltage to be applied to the main charge roller 2 in accordance with the variations of the environmental temperature or for heating the main charge roller 2. Thereby, the manufacturing cost for these additional mechanisms are reduced.

Figure 11:
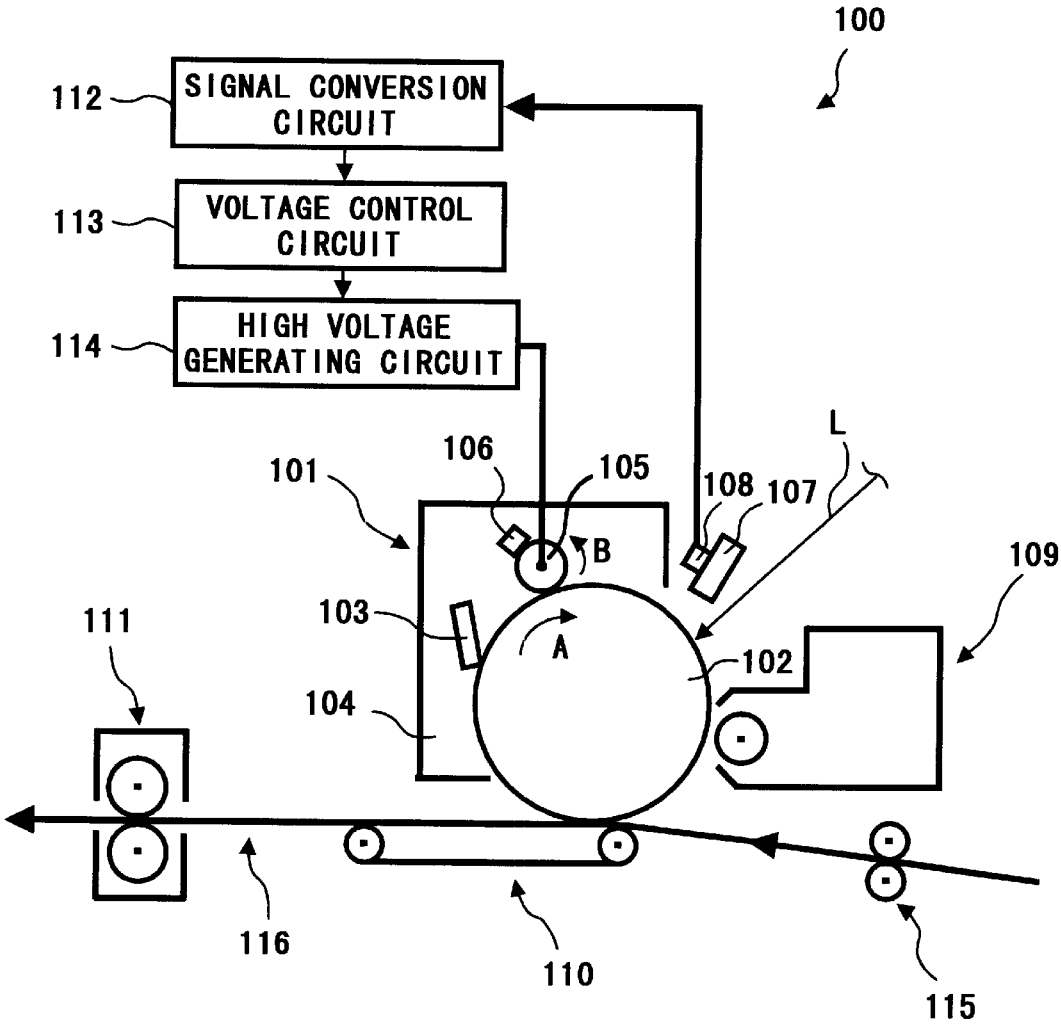
FIG. 11 is an illustration for showing an image forming mechanism according to an embodiment of the present invention.

Next, another exemplary main charge system according to an embodiment of the present invention is explained with reference to FIG. 11. FIG. 11 illustrates an image forming mechanism 100 including a main charge system based on the main charge system 50 of FIG. 1. The image forming mechanism 100 includes a process cartridge 101, an eraser 107, a temperature detector 108, a development unit 109, a transfer. unit 110, a fixing unit 111, a signal conversion circuit 112, a voltage control circuit 113, a high voltage generating circuit 114, and registration rollers 115. These elements are arranged as illustrated in FIG. 11. The process cartridge 101 includes a drum-shaped photoconductive member 102, a cleaning blade 103, a toner collector 104, a main charge roller 105, and a charged-roller cleaner 106. In FIG. 11, an arrow indicated by a letter L shows laser light emitted from an optical writing system (not shown).

In the image forming mechanism 100, the main charge roller 105 is arranged to make contact with, or to be close to, the surface of the photoconductive member 102 and the high voltage power generating circuit 114 supplies a high voltage to the main charge roller 105. The photoconductive member 102 is thereby charge with the high voltage. The temperature detector 108 detects a temperature of and around the surface of the main charge roller 105 and generates a signal variable in accordance with the detection result. The signal generated by the temperature detector 108 is converted by the signal conversion circuit 112 and is sent to the voltage control circuit 113. The voltage control circuit 113 calculates the electric field based on the signal sent from the signal converting circuit 112 to obtain a voltage necessary to apply to the main charge roller 105 so as to generate a desired charge potential on the photoconductive member 102. Based on this calculation, the voltage control circuit 113 controls the high voltage power generating circuit 114 to apply a necessary voltage to the main charge roller 105. Thereby, the photoconductive member 102 will have an appropriate charge potential.

The voltage control circuit 113 includes a memory (not shown) for storing a data table including data representing a relationship between a temperature and a resistance ratio of each roller layer of the main charge roller 105. When the voltage control circuit 113 receives a signal from the temperature detector 108 via the signal conversion circuit 112, it uses the data table stored in the memory thereof to obtain a resistance ratio or each roller layer. Then, the voltage control circuit 113 calculates the electric field, explained later, based on the obtained resistance ratio of each roller layer. Based on the calculation, the voltage control circuit 113 sends a signal for instructing the high voltage power generating circuit 114 to apply a voltage necessary for the photoconductive member 102 to have the charge potential on the surface thereof.

The calculations are based on the Ohm's law with consideration given to the advection member, i.e., the charge flow in the two-dimensional directions within each of the elastic layer 5 and the surface layer 6, the two-dimensional Poisson's equation, and the Paschen's discharge law. Since each roller layer of the main charge roller 105 and the photoconductive member 102 change a resistance, a thickness, and a capacitor over time, the voltage control circuit 113 takes these variations into account during the above-mentioned calculations.

The charged-roller cleaner 106 is configured to contact the surface of the main charge roller 105 so that the surface of the main charge roller 105 is cleared by the charge-droller cleaner 106 when the main charge roller 105 is rotated. Thereby, the cleaning process is performed relative to the surface of the main charge roller 105.

In FIG. 11, the photoconductive member 102 is rotated in the direction indicated by a letter A, following to which rotation the main charge roller 105 rotates in the direction indicated by a letter B. The high voltage power generating circuit 114 applies a voltage to the main charge roller 105 so that the surface of the photoconductive member 102 is evenly charged. An optical writing unit (not shown) emits laser light indicated by the letter L to which the charged surface of the photoconductive member 102 is exposed, thereby forming an electrostatic latent image thereon. The electrostatic latent image is then developed with toner by the development unit 109. Thereby, a toner image is formed on the photoconductive member 102.

The transfer unit 110 transfers the thus-formed toner image onto a recording sheet 116 supplied from a sheet supply unit (not shown). After that, the recording sheet having the toner image thereon is fed into the fixing unit 111 in which the toner is fixed on the recording sheet and is then ejected to an eject tray (not shown) or the like. The toner which is not used and remains on the photoconductive member 102 is scraped off by the cleaning blade 103 and is collected into the toner collector 104.

In the image forming system 100, the temperature detector 108 detects the temperature around the main charge roller 105 during the above-described process of the image forming operation. The temperature information from the temperature detector 108 is sent to the signal conversion circuit 112 in which the temperature information is converted into an electric signal. Then, this signal is sent to the voltage control circuit 113.

The voltage control circuit 113 uses the data table including data representing the relationship between the temperature and the resistance ratio of each roller layer of the main charge roller 105 so as to obtain a suitable resistance ratio in accordance with the temperature information. The voltage control circuit 113 calculates the electric field to determine a voltage necessary for the photoconductive member 1 to have an appropriate charge potential on the surface thereof. After that, the voltage control circuit 113 controls the high voltage power generating circuit 114 to supply the determined voltage to the main charge roller 105. Thereby, the high voltage power generating circuit 114 supplies an appropriate voltage to the main charge roller 105. Accordingly, the photoconductive member 102 is caused to have an appropriate charge potential on the surface thereof.

Figure 12:
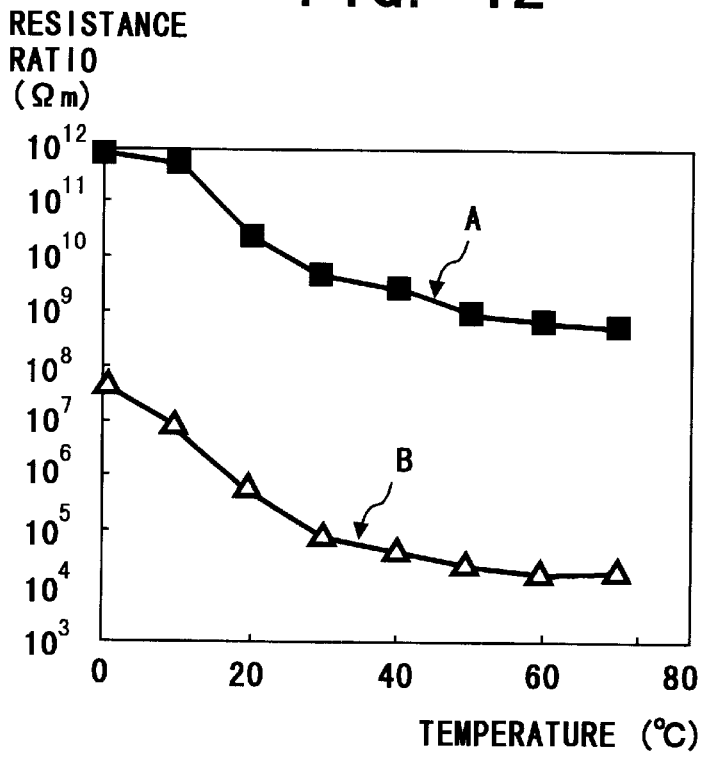
FIG. 12 is a graph for showing relationships between the resistance ratio of the elastic layer and a temperature of the main charge roller and between the resistance ratio of the surface layer and the temperature of the main charge roller, respectively.
Figure 13:
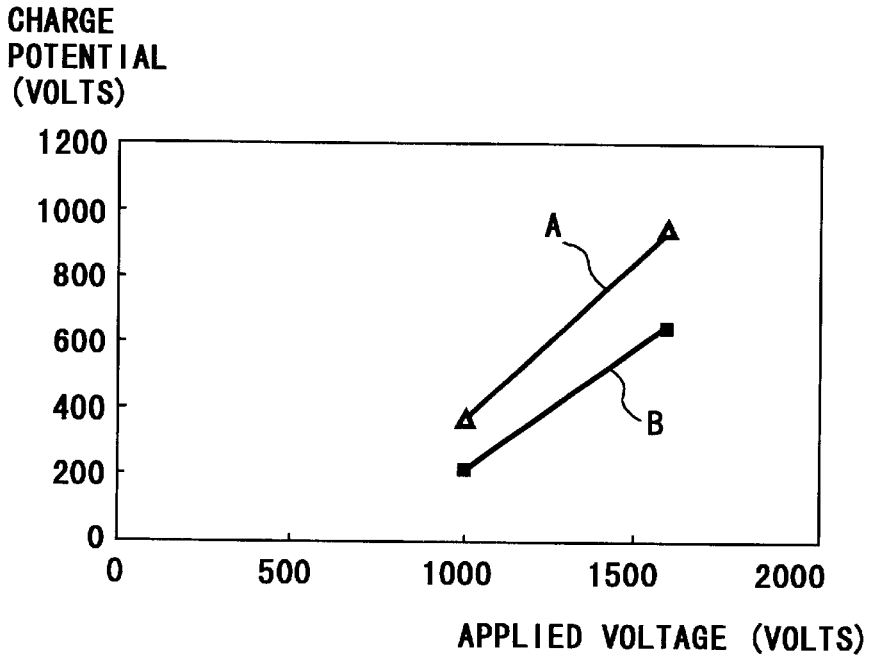
FIG. 13 is a graph for showing relationships between the charge potential of the photoconductive member and the voltage applied to the main charge roller based on the resistance ratio of FIG. 12 with the variations of the temperature of the main charge roller.

Referring to FIGS. 12 and 13, the electric field calculation performed by the voltage control circuit 113 is explained. FIG. 12 shows relationships between the resistance ratio of the roller layers of the main charge roller 105 and the temperature around the main charge roller 105. More specifically, a line indicated by a letter A is a relationship between the resistance ratio of the surface layer of the main charge roller 105 and the temperature around it. Another line indicated by a letter B is a relationship between the resistance ratio of the elastic layer of the main charge roller 105 and the temperature around it.

The voltage control circuit 113 obtains the resistance ratio of each roller layer of the main charge roller 105 in accordance with the temperature detected by the temperature detector 108 based on the relationships of FIG. 12. Since such a relationship between the resistance ratio of each roller layer and the temperature around the main charge roller 105 is inherent in the material used, a one-time measurement would be sufficient. However, the main charge roller 105 will have deterioration over time which may cause variations of performance. Therefore, when a material causing a great deterioration over time is used, the data representing the variations of performance over time is also needed to be stored.

In the image forming mechanism 100, the above-mentioned data representing the variations of performance over time is stored in the memory of the voltage control circuit 113 so that the voltage control circuit 113 can take such data into account when calculating the resistance ratio of each roller layer of the main charge roller 105 based on the temperature detected by the temperature detector 108. Thereby, the voltage control circuit 113 can accurately control the voltage to be applied to the main charge roller 105.

Based on the thus-calculated resistance ratio of each roller layer, the voltage control circuit 113 further calculates the voltage to be applied to the main charge roller 105 and then the relationship between the application voltage and the charge potential of the photoconductive member 102, that is, the charge performance of the main charge roller 105. Since the charge performance can normally be approximated by a straight line, the voltage control circuit 113 uses two conditions of the application voltages for the calculation and approximates the result with a one-dimensional line. FIG. 13 shows the charge performance obtained in this way, wherein lines indicated by letters A and B represent cases of temperatures 20° C. and 10° C., respectively.

Although there are several ways for calculating the charge performance, a two-dimensional calculation based on a section of the main charge roller would be optimum. That is, the one-dimensional calculation would be insufficient in accuracy because it cannot take it into account that the charge moves in the circumference direction. The three-dimensional calculation would calculate accurately enough but it would be a too complex calculation and require a relatively long time to obtain a result which would have little difference from that obtained by the two-dimensional calculation.

Therefore, the two-dimensional calculation is an optimum method for calculating the charge performance of the main charge roller. An actual calculation method may be one of the calculus of finite differences, the boundary element method, the finite element method, the principle of charge superposition, and so forth. This calculation calculates the amount of charge moving from the main charge roller to the photoconductive member so as to obtain the charge performance, which equals to the relationship between the application voltage and the charge potential, using the formulae of FIGS. 3A–3E based on the Ohm's law, Poisson's equation, and the Paschen's discharge law, as described earlier.

By the above-mentioned charge performance, when the charge potential of, for example, 600 volts is desired, the application voltage is 1200 volts in case of the temperature of 20° C. and is 1500 volts in case of the temperature of 10° C., as shown in FIG. 13.

In this way, the image forming mechanism 100 can maintain the charge potential of the photoconductive member 102 at a constant level by controlling the application voltage to be applied to the main charge roller 105 based on the temperature around the main charge roller 105. In other words, the image forming mechanism 100 is configured to detect the variations of the temperature around the main charge roller 105 and to adjust the application voltage based on the detected temperature variations. Therefore, the image forming mechanism 100 is able to maintain a constant charge potential under the conditions in which the temperature varies, thereby producing an image in a superior quality.

In addition, the image forming mechanism 100 does not need to heat the main charge roller 105 and can avoid the problems such as the toner blocking and the deterioration of toner agglomeration.

It is preferable that the temperature detector 108 is arranged to be as close as possible to the main charge roller 105. However, when temperature detector 108 contacts the main charge roller 105, the main charge roller 105 may have a rough surface which results in an uneven charge potential. Therefore, the temperature detector 108 is arranged to be at a position where the temperature detector 108 does not contact the main charge roller 10s but can properly detect the temperature of the main charge roller 105. Of course, when the main charge roller 105 is made of material strong resistant from becoming rough surface, the temperature detector 108 may be arranged in a place to contact the main charge roller 105.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letters Patent of the United States is:

1. A charging apparatus, comprising:

a charge roller configured to adjoin to a photoconductive member so as to provide a charge to a surface of the photoconductive member, said charge roller comprising a plurality of roller layers including an elastic layer and a surface layer, said elastic layer having a resistivity such that a roller surface potential is raised by a charge movement, said resistivity of the elastic layer having a value such that a time period in which a charge moves within said elastic layer is sufficiently smaller than a time period in which an arbitrary point of said surface of said charge roller moves across a discharge region formed between said charge roller and the photoconductive member, wherein the resistivity of the elastic layer is less than $10^6$ Ωm and a resistivity of the surface layer is greater than $10^{10}$ Ωm such that a charge potential of the surface of the photoconductive member is substantially constant even under different environmental conditions.

2. A charging apparatus, comprising:

a charge roller configured to adjoin to a photoconductive member so as to provide a charge to a surface of the photoconductive member, said charge roller comprising an elastic layer and a surface layer, said elastic and surface layers having resistivities such that when a charge performance of said charge roller is obtained by calculating a relationship between each of the resistivities of said elastic and surface layers and a charge potential of the surface of the photoconductive member using formulae of an Ohm's law with consideration given to an advection member for a charge flow in two-dimensional directions within each of said elastic and surface layers, a two-dimensional Poisson's equation, and a Paschen's discharge law, said calculated relationship includes two constant-potential regions in both which said charge potential stays at an approximate constant level relative to said resistivities and a resistivity in one of said two constant-potential region is selected, wherein the resistivity of the elastic layer is less than $10^6$ Ωm and the resistivity of the surface layer is greater than $10^{10}$ Ωm such that the charge potential of the surface of the photoconductive member is substantially constant even under different environmental conditions.

3. An image forming apparatus, comprising:

a photoconductive member;

a charging mechanism for charging said photoconductive member, said charging mechanism comprising a charge roller configured to adjoin to said photoconductive member so as to provide a charge to a surface of said photoconductive member, said charge roller comprising a plurality of roller layers including an elastic layer and a surface layer, said elastic layer having a resistivity with which a roller surface potential is raised by a charge movement, said resistivity of the elastic layer having a value such that a time period in which a charge moves within said elastic layer is sufficiently smaller than a time period in which an arbitrary point of said surface of said charge roller moves across a discharge region formed between said charge roller and said photoconductive member, wherein the resistivity of the elastic layer is less than $10^6$ Ωm and a resistivity of the surface layer is greater than $10^{10}$ Ωm such that a charge potential of the surface of the photoconductive member is substantially constant even under different environmental conditions.

4. An image forming apparatus, comprising:

a photoconductive member;

a charging mechanism for charging said photoconductive member, said charging mechanism comprising a charge roller configured to adjoin to said photoconductive member so as to provide a charge to a surface of said photoconductive member, said charge roller comprising an elastic layer and a surface layer, said elastic and surface layers having resistivities such that when a charge performance of said charge roller is obtained by calculating a relationship between each of the resistivities of said elastic and surface layers and a charge potential of said surface of said photoconductive member using formulae of an Ohm's law with consideration given to an advection member for a charge flow in two-dimensional directions within each of said elastic and surface layers, a two-dimensional Poisson's equation, and a Paschen's discharge law, said calculated relationship includes two constant-potential regions in both which said charge potential stays at an approximate constant level relative to said resistivities and a resistivity in one of said two constant-potential region is selected, wherein the resistivity of the elastic layer is less than $10^6$ Ωm and the resistivity of the surface layer is greater than $10^{10}$ Ωm such that the charge potential of the surface of the photoconductive member is substantially constant even under different environmental conditions.

* * * * *